US005507577A

United States Patent [19]

Fowler

[11] Patent Number: 5,507,577

[45] Date of Patent: Apr. 16, 1996

[54] COMMERCIAL LAUNDRY COLLECTION APPARATUS

[76] Inventor: Charles A. Fowler, Huntington Downs, Apartment 322, Greenville, S.C. 29650

[21] Appl. No.: 226,289

[22] Filed: Apr. 11, 1994

[51] Int. Cl.[6] ..... B65D 33/14

[52] U.S. Cl. ..... 383/7; 383/33; 383/71; 383/77; 248/99; 248/100; 220/404

[58] Field of Search ..... 383/7, 33, 62, 383/71, 77, 14, 35, 117, 907, 6, 903; 248/99, 100; 220/404

[56] References Cited

U.S. PATENT DOCUMENTS

| | | | |
|---|---|---|---|
| 616,249 | 12/1898 | Nickerson . | |
| 1,910,789 | 5/1933 | Brady . | |
| 2,543,299 | 2/1951 | Pritchard | 383/7 |
| 2,761,481 | 7/1954 | Boatwright . | |
| 3,052,399 | 6/1959 | Brown . | |
| 3,186,626 | 6/1965 | Shvetz . | |
| 4,207,937 | 6/1980 | Sandeman et al. . | |
| 4,445,230 | 4/1984 | Spadaro . | |
| 4,524,457 | 6/1985 | Marino . | |
| 4,597,103 | 6/1986 | Hoover | 383/903 X |
| 4,646,802 | 3/1987 | Basore et al. | 383/33 X |
| 4,703,517 | 10/1987 | Marino . | |
| 4,753,538 | 6/1988 | Jorda . | |
| 4,822,178 | 4/1989 | Taylor | 383/33 |
| 4,989,749 | 2/1991 | Choi | 220/404 X |
| 5,082,219 | 1/1992 | Blair | 383/33 X |

FOREIGN PATENT DOCUMENTS

| | | | |
|---|---|---|---|
| 0018201 | 1/1990 | Japan | 383/77 |

*Primary Examiner*—Jes F. Pascua
*Attorney, Agent, or Firm*—Dority & Manning

[57] ABSTRACT

A commercial laundry collection apparatus having a removable laundry bag maintained on a bag stand. The bag stand includes a bag supporting portion freely expandable to a predetermined extent. A bag body of the laundry bag has a larger bottom portion tapering to a smaller upper portion defining a bag mouth. The smaller upper portion is folded back upon the bag supporting portion of the bag stand such that the bag mouth will be open for receipt of soiled laundry. The upper portion of the bag body is dimensioned such that the bag supporting portion of the bag stand will be unable to completely expand to the predetermined extent. As a result, the bag supporting portion of the bag stand will impart an outward force tending to maintain the laundry bag thereon. The laundry bag further includes a pair of longitudinal tie members attached to the upper portion of the bag body at respective opposite locations across the bag mouth. To lessen incidence of tangling, such tie members are narrower at a first end portion attached to the bag body than at a second end portion thereof.

19 Claims, 5 Drawing Sheets

COMMERCIAL LAUNDRY COLLECTION APPARATUS

BACKGROUND OF THE INVENTION

The present invention relates to a commercial laundry collection apparatus of the type having a removable laundry bag maintained on an appropriate bag stand for receipt of soiled laundry.

In various commercial and institutional facilities, apparatus are often provided for collection of soiled laundry generated during operation of the facility. Generally, the apparatus will include an expandable bag stand upon which a removable laundry bag is maintained. The soiled laundry is deposited into the laundry bag, which is removed from the bag stand when full. Generally, full bags will be picked up on a regular schedule by a commercial laundry service. The commercial laundry service will then typically wash the bag with its contents inside an industrial washing machine.

The standard laundry bag which has been used for this purpose has a width of approximately 30 inches and a height of approximately 40 inches. The bag is formed of two rectangular pieces of fabric which are stitched together across the bottom and up the two sides. The upper portion of the laundry bag remains open to define a bag mouth. A narrow piece of material is stitched around the circumference of the top edge of the laundry bag to define a hollow tunnel. A drawstring is inserted into this hollow tunnel to act as a closure. Specifically, when the ends of the drawstring are pulled, the mouth of the laundry bag closes. The ends of the drawstring may be tied together to keep the contents of the bag inside during transit and washing.

Two types of stands are generally used with the standard laundry bag. The first type is generally referred to as the up-right stand. The up-right stand has four rigid rods extending upwardly from the respective corners of a rectangular base. The laundry bag is maintained in the area between the upstanding rods by folding the upper portion of the laundry bag over the upper end of each rod.

The second type of stand is referred to as the x-stand. The x-stand is constructed of a pair of generally rectangular frame members interconnected at their respective midpoints to pivot. In this manner, the frame members may be expanded to a predetermined maximum extent at which the stand resembles an "X" when viewed on end. The laundry bag is maintained on the stand by loosely folding an upper portion of the laundry bag over the respective tops of the rectangular frame members, which thus serves as a bag supporting portion of the stand.

Prior art laundry collection apparatus, such as described above, have suffered from a number of significant disadvantages. First, the laundry bags have had an excessive tendency not to remain on the bag stand. As an illustration, consider a typical environment—the back kitchen area of a restaurant. In this case, the laundry bag may be used to collect various types of soiled laundry, including relatively heavy tablecloths. Generally, such laundry is thrown from a distance by a very busy staff. As expected, some pieces of laundry will land in the bag as desired. Other pieces, however, will hit the upper portion of the bag, causing it to be displaced from the bag stand. Often, the restaurant staff will continue to throw pieces of laundry toward the bag, resulting in a pile of laundry on the floor.

Another significant problem which occurs with a standard laundry bag is tangling of the drawstring during washing. Unlike a household washing machine, an industrial washing machine holds between 50 and 800 pounds of laundry per load. Such machines typically load from the front and turn in full revolution (clockwise six times, then counterclockwise six times). Because of their light weight and rough surface, the drawstrings of the laundry bags tend to wrap around and twist together during the washing process. Often, the drawstrings of several laundry bags will become tangled together. When this happens, the wash attendant must generally cut off all of the drawstrings to get them untangled.

In an effort to overcome the problem of drawstring tangling, the assignee of the present invention developed a laundry bag which did not have a drawstring. Instead, this prior art laundry bag utilized a pair of flat tie members attached to the upper portion of the laundry bag at opposite locations across the bag mouth. The tie members were approximately 45 centimeters in length and had a substantially uniform width of approximately 5 centimeters. When this laundry bag was full, the tie members were tied together to close the mouth of the laundry bag for transit and washing.

While this laundry bag did eliminate the drawstring, the tie members still had a tendency to tangle during washing. Additionally, the tie members of this laundry bag would often come untied by themselves. Furthermore, like the standard laundry bag, this laundry bag had a tendency to fall off of the bag stand.

SUMMARY OF THE INVENTION

The present invention recognizes and addresses the foregoing disadvantages and others of the prior art. Accordingly, it is an object of the present invention to provide an improved laundry collection apparatus of the type having a removable laundry bag maintained upon an expandable bag stand.

It is a more particular object of the present invention to provide a commercial laundry collection apparatus as described in which the laundry bag has a significantly reduced tendency to fall off of the bag stand.

It is a further object of the invention to provide an improved laundry bag suitable for use with an expandable bag stand.

It is a particular object of the present invention to provide a laundry bag which is easily closed but which does not undesirably open during transit or washing.

It is also a particular object of the invention to provide a laundry bag which does not become tangled with other laundry bags during washing in an industrial washing machine.

Some of these objects are achieved by a commercial laundry collection apparatus having a removable laundry bag maintained on a bag stand. The bag stand includes a bag supporting portion freely expandable to a predetermined extent. The removable laundry bag has a bag body constructed of flexible sheet material and configured to retain soiled laundry. The bag body has a larger bottom portion tapering to a smaller upper portion defining a bag mouth. The smaller upper portion is folded back upon the bag supporting portion of the bag stand such that the bag mouth will be open for receipt of the soiled laundry. In accordance with the present invention, the upper portion of the bag body is dimensioned such that the bag supporting portion of the bag stand will be unable to completely expand to the predetermined extent. As a result, the bag supporting portion of the bag stand will impart an outward force tending to maintain the laundry bag thereon.

In presently preferred embodiments, the laundry bag further includes a pair of longitudinal tie members attached to the upper portion of the bag body at respective opposite locations across the bag mouth. Preferably, such tie members are substantially flat and respectively extend from a first end portion attached to the bag body to a second end portion longitudinally distal from the first end portion. In accordance with the present invention, the first end portion of each such tie member has a narrower width than the second end portion thereof. In a preferred configuration, each of the tie members may have a substantially constant width from the second end portion back to a selected intermediate location. At the selected intermediate location, which may be referred to as the "break" location, the respective tie member will preferably taper in a uniform manner to the narrower width at the first end portion.

Certain specific dimensions have been found to be particularly useful in the exemplary construction. For example, it is preferred that the height of the laundry bag be approximately 103 centimeter when configured for use with an expandable bag stand having industry-standard dimensions. In this case, the lateral extent of the bottom portion of the bag body will preferably fall within a range of approximately 73 to 90 centimeters. Similarly, the lateral extent of the upper portion of the bag body may preferably fall within a range of approximately 69 to 86 centimeters. Under the most preferred conditions, the lateral extent of the bottom portion may be approximately 74.5 centimeters, with the lateral extent of the upper portion being approximately 70 centimeters. This gives a taper from the bottom portion to the top portion of approximately 1 centimeter in width per every 23 centimeter in height.

In the exemplary construction, the length of the tie members may preferably fall within a range of approximately 27 to 28 centimeters. A most preferred length for the tie members in this regard is approximately 27 centimeters. The width of the tie members in the exemplary construction may be approximately 2 centimeters at the first end portion and 7.5 centimeters at the second end portion. The break location of the tie members may preferably be approximately 20.5 centimeters from the second end portion in the exemplary construction.

Other objects, features, and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying figures, in which.

Figure 1:
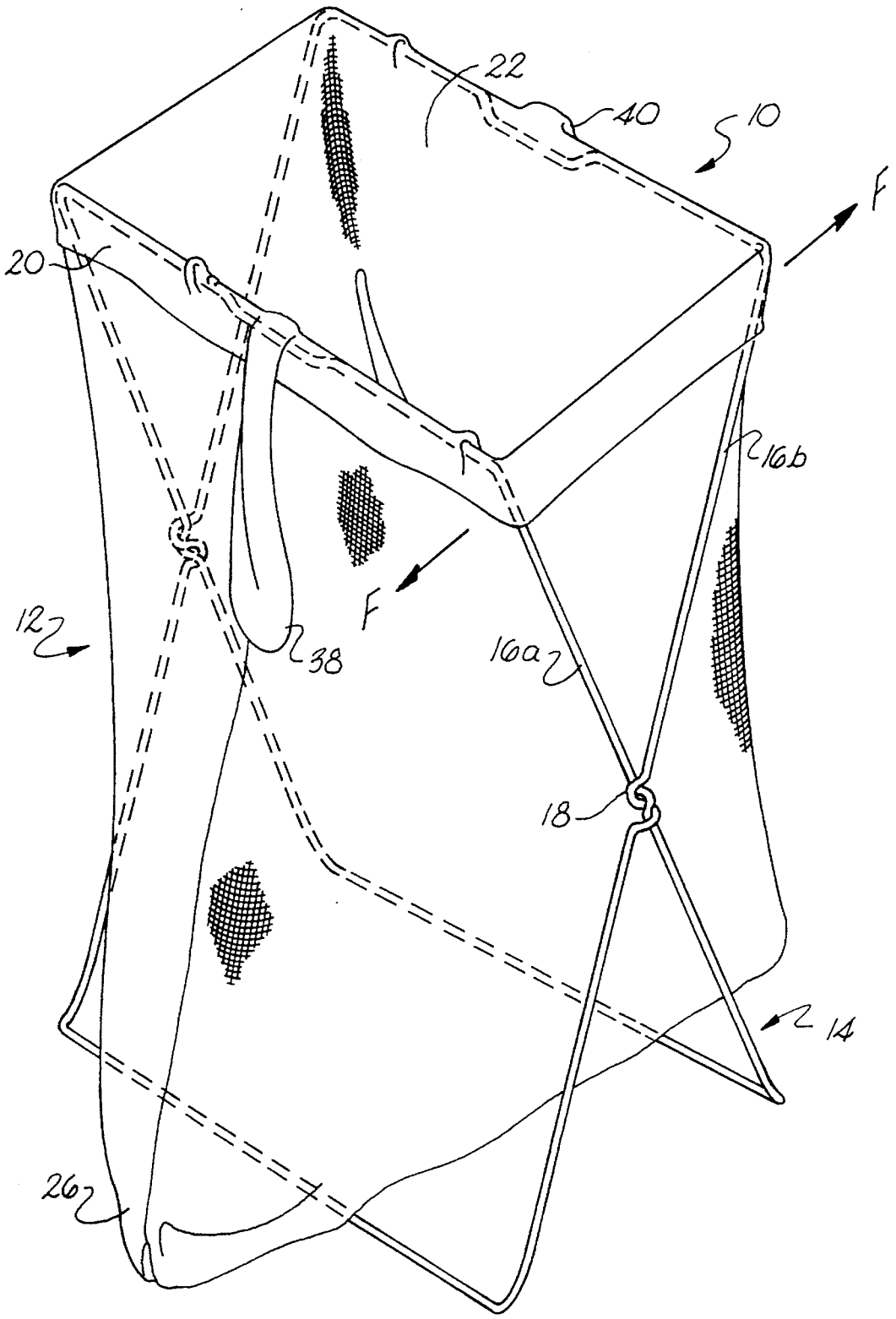
FIG. 1 is a perspective view of a commercial laundry collection apparatus constructed in accordance with the present invention in which the laundry bag thereof is empty.

Repeat use of reference characters in the present specification and figures is intended to represent same or analogous features or elements of the invention.

DETAILED DESCRIPTION OF PREFERRED EMBODIMENTS

It is to be understood by those of ordinary skill in the art that the present discussion is a description of exemplary embodiments, and is not intended as limiting the broader aspects of the present invention, which broader aspects are embodied in the exemplary embodiments.

Figure 2:
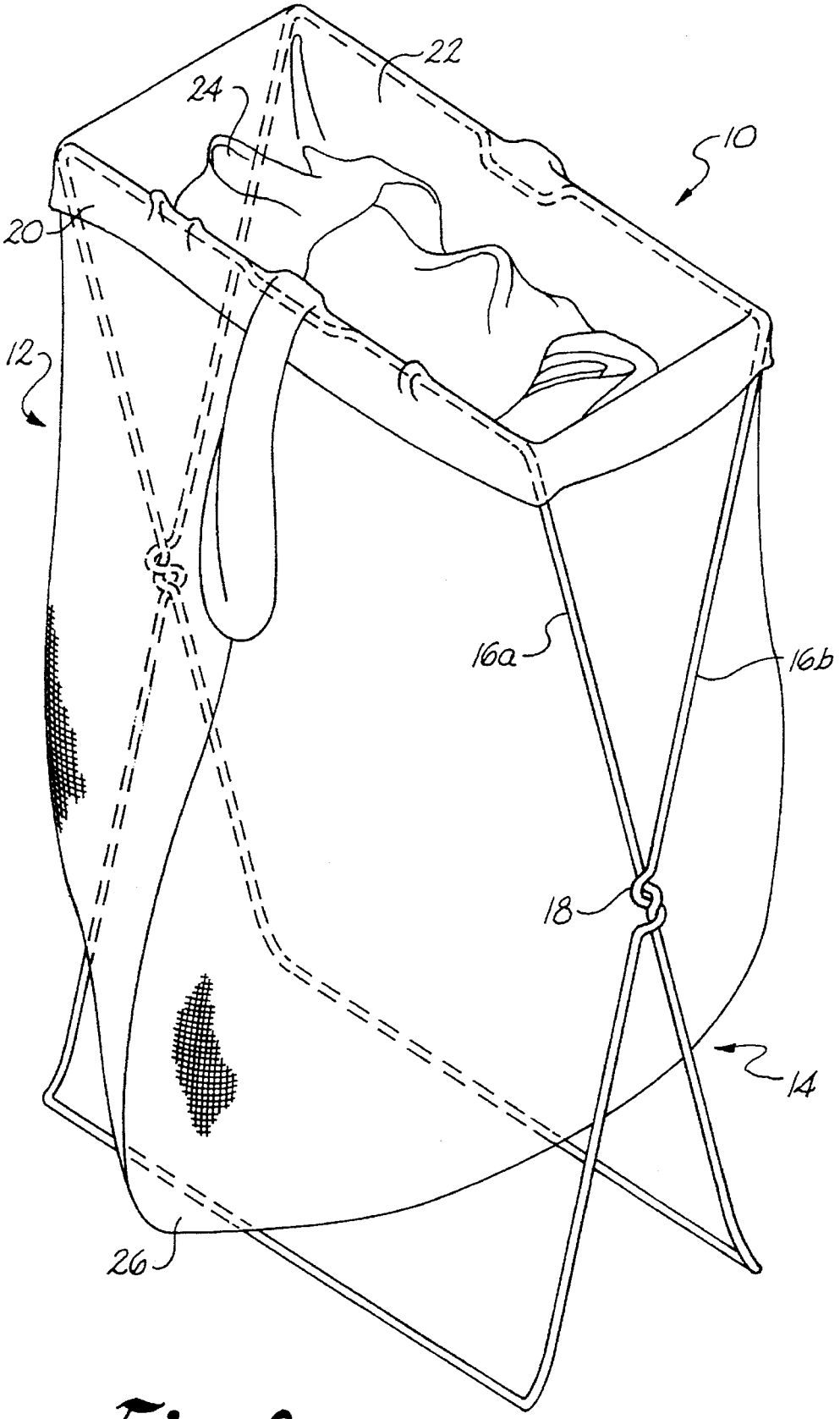
FIG. 2 is a view similar to FIG. 1 in which the laundry bag is full of soiled laundry.

A presently preferred embodiment of a commercial laundry collection apparatus constructed in accordance with the present invention is shown in FIGS. 1 and 2 and is generally referenced therein as 10. Such laundry collection apparatus includes a removable laundry bag 12 maintained on a bag stand 14. As can be seen, stand 14 is, in this case, of the known type referred to as an x-stand.

Stand 14 is constructed having two generally rectangular members **16*a*, 16*b* which are preferably formed of steel rod or the like. Members 16*a*, 16*b* are interlocked as shown at intermediate location 18 to permit pivoting movement with respect to one another. This arrangement allows members 16*a*, 16*b*** to open to a predetermined maximum extent, but not farther.

An upper portion 20 of laundry bag 12 is outwardly folded as shown over a bag supporting portion of bag stand 14. As a result, bag mouth 22 of laundry bag 12 will be open for receipt of soiled laundry therethrough. This can be seen more clearly in FIG. 2, where laundry bag 12 is shown full of soiled laundry 24.

As discussed above, the prior art has experienced considerable difficulty in effectively maintaining a laundry bag upon a bag stand. The present invention resides in part on a recognition that a reason for this failure has been that the bag supporting portion of the bag stand will expand all of the way to the maximum extent when the laundry bag is positioned thereon. Bag 12, on the other hand, is configured such that the natural tendency of stand 12 to spread open may be advantageously used to impart an outward force tending to maintain bag 12 upon stand 14. This outward force, which is indicated by the arrows F, applies increasing tension to upper portion 20 as a greater amount of soiled laundry 24 is placed in bag 12.

Figure 3:
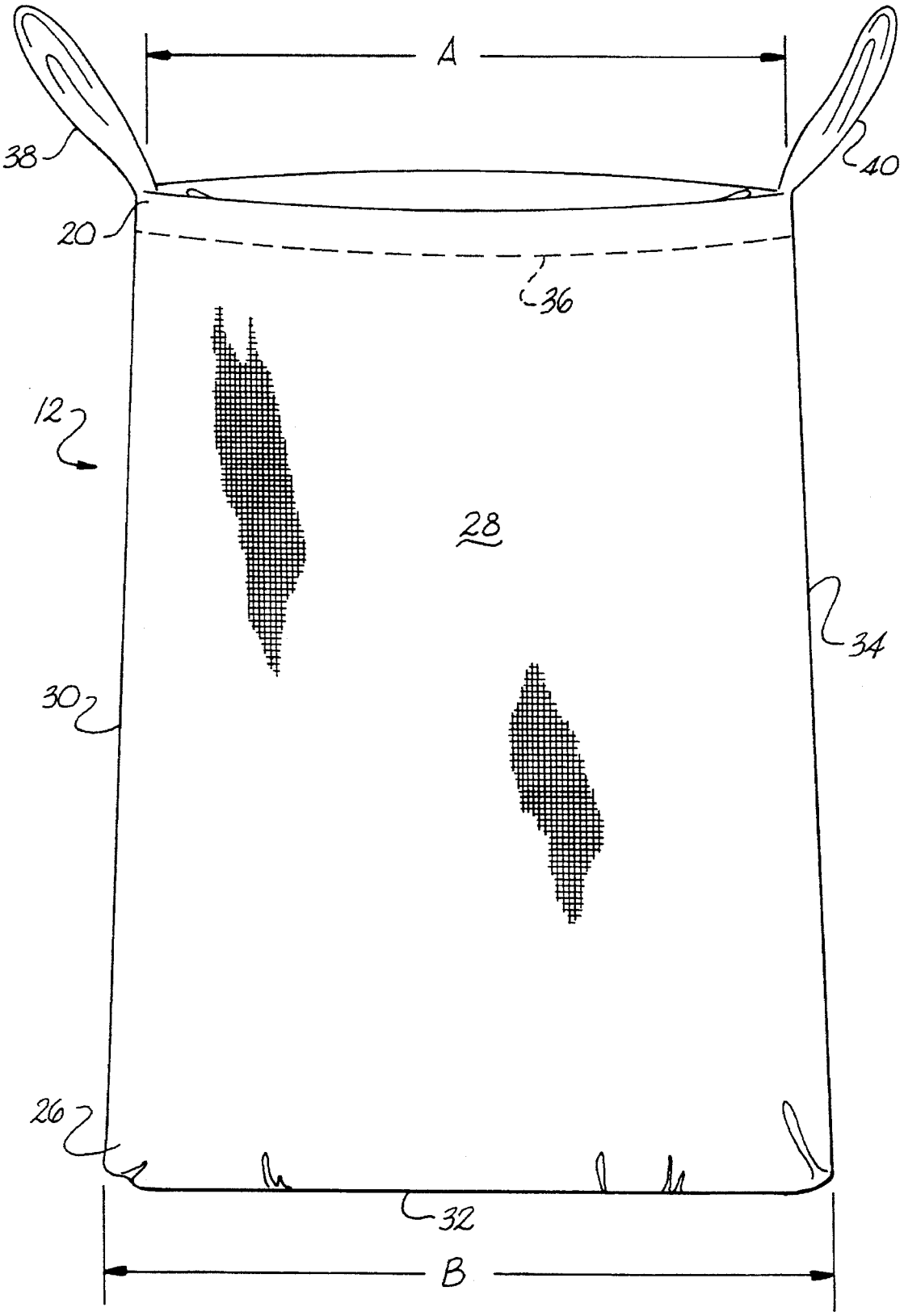
FIG. 3 is an elevation of a laundry bag constructed in accordance with the invention as shown extended to be substantially flat.

The construction of laundry bag 12 to facilitate the application of force F can be most easily understood with reference to FIG. 3. Preferably, bag body 28 is constructed of a single piece of suitable fabric which is folded along left edge 30. The fabric is then stitched along bottom edge 32 and right edge 34 to form an enclosure. A single ply of such fabric will generally be suitable, except that upper portion 20 is preferably reinforced by doubling back a short length of fabric and then stitching along line 36.

As can be seen, bottom portion 26 has a lateral extent B which is greater than a lateral extent A of upper portion 20. The sides of bag 12 then preferably taper in a uniform manner from bottom portion 26 to upper portion 20. This gradual decrease in the lateral extent of bag body 28 ensures that upper portion 20 will be properly dimensioned to receive force F. Bottom portion 26, however, will remain open and loose to contain laundry, as desired.

Figure 4:
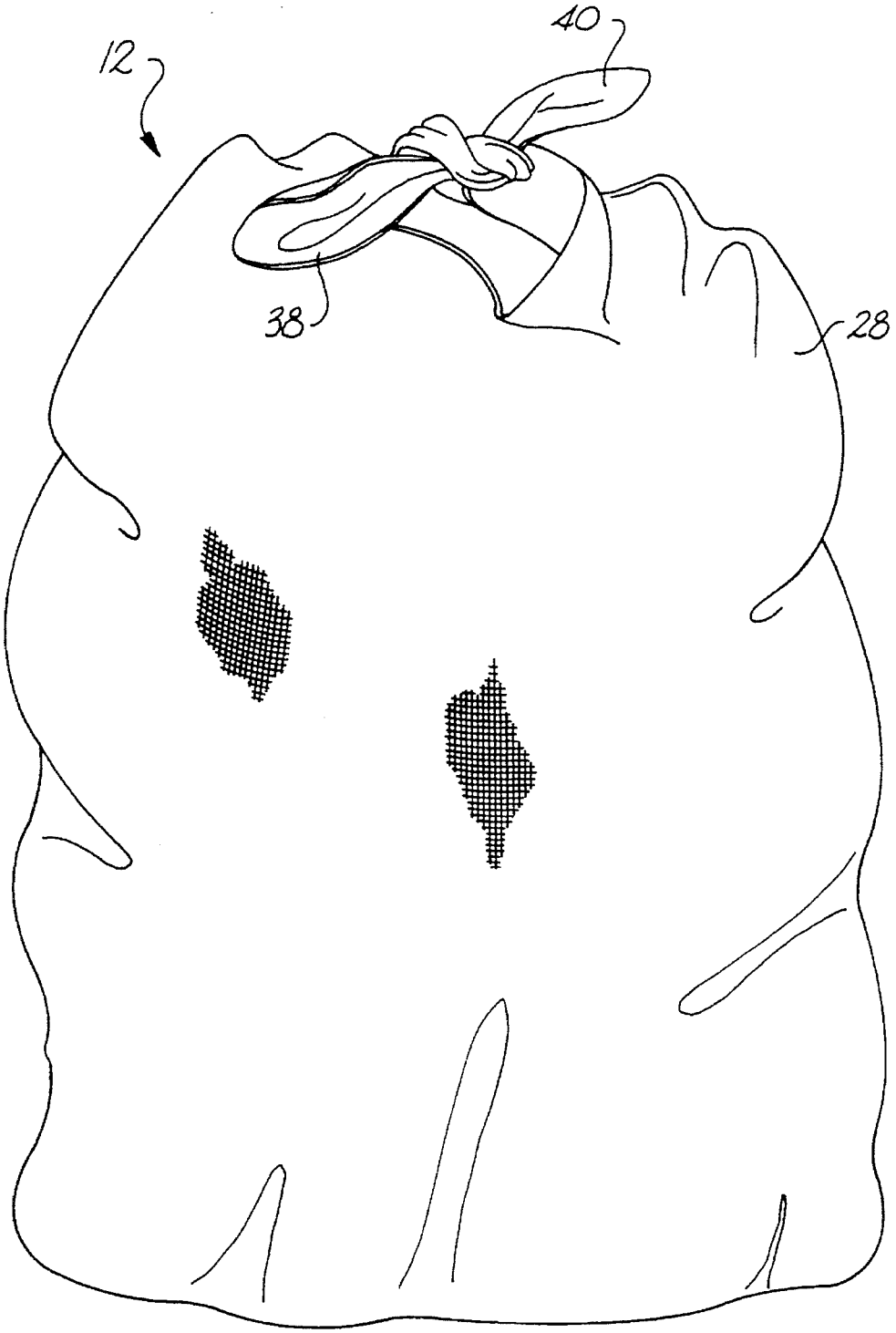
FIG. 4 is a laundry bag constructed in accordance with the invention in which bag mouth is closed and tied shut by the tie members.

Bag 12 further includes a pair of tie members 38 and 40 attached to upper portion 20 of bag body 28. As shown in FIG. 4, tie members 38 and 40 are utilized in lieu of the drawstring of prior art laundry bags to close bag 12 during transit or washing. As discussed above, a laundry bag has been developed which utilized tie members, but such tie members proved to be inadequate for a number of reasons. Specifically, these tie members have exhibited a tendency to frequently become untied. Furthermore, like drawstrings, such tie members have often tangled during washing.

Figure 5:
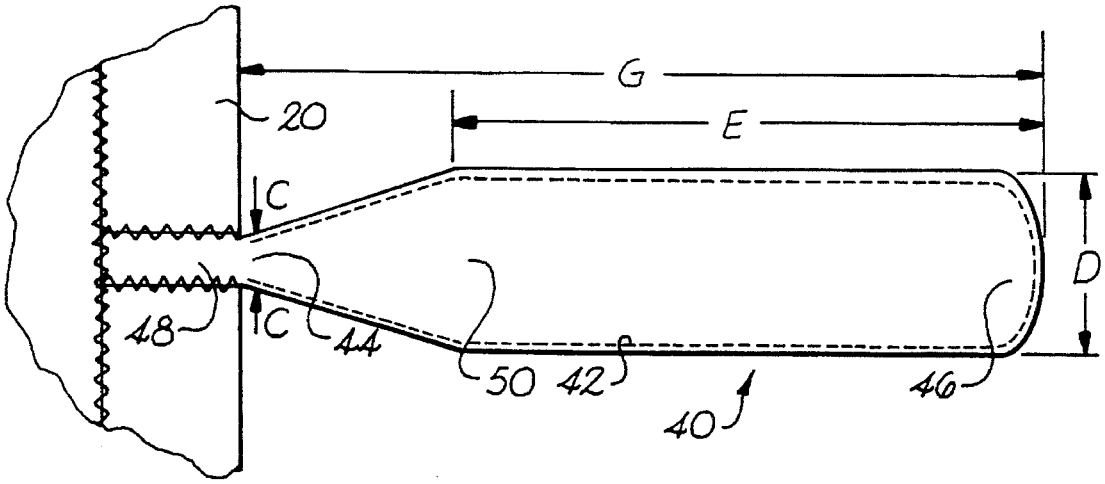
FIG. 5 is a plan view of a single tie member of the laundry bag of FIG. 3.

Tie members 38 and 40 overcome many of the deficiencies of the prior art utilizing a unique configuration, which is most easily understood with reference to FIG. 5. FIG. 5 specifically illustrates tie member 40, although it should understood that tie member 38 is preferably identical thereto. Preferably, tie members 38 and 40 are constructed of two plies of fabric material which are stitched together about their periphery, as shown at 42. This two-ply construction gives tie member 40 sufficient strength to serve, along with tie member 38, as respective handles for carrying bag 12. A preferred material for this purpose is a poly/cotton blend material because it has a surface abrasiveness which further tends to keep the tie members from coming untied.

As shown, tie members 38 and 40 longitudinally extend when lying flat from a proximal end 44 to a distal end 46. Proximal end 44 has an integral overlapping portion 48 which is attached to upper portion 20 of bag body 26 via stitching as shown.

As can be seen, the width C of proximal end 44 is narrower than the width D of distal end 46. In presently preferred embodiments, the width of tie members 38 and 40 will be substantially invariant from end portion 46 back to a selected intermediate, or "break" location 50. The distance from end portion 46 to break location 50 may then be designated as distance E, which is a portion of the overall length G of the respective tie member. From break location 50, the width of tie members 38 and 40 decrease in a uniform taper to proximal end portion 44.

Testing was performed in order to determine specific dimensions that would be particularly useful in the exemplary construction. Such testing involved placing each test bag on a stand and filling it full of linen. The purpose of the test was to duplicate the operational environment of the bag and stand. When the bag would fail to remain on the stand, the shape would then be tapered down until the bag remained securely on the stand. Attempts to maintain the bag on the stand by simply extending the height of the bag did not appear to offer further improvements.

A series of reductions were then begun, not only to the height of the bag but also to the upper width. According to theories of the present invention, pressure developed by the stand itself would assist in maintaining the bag on the stand. This was validated by the testing, which showed that certain dimensions resulted in a noticeable improvement in this regard.

Testing of the tie members was also conducted. A set of tie members measuring 45 centimeters in length and 5 centimeters in overall width was found to tangle in the wash process. The length was then reduced at 2 centimeter intervals and placed into a wash wheel to test the results. At a length of 27–28 centimeters, a substantial reduction in the incidence of tangling was noted.

Based on these results, the bag is therefore preferably constructed having a height of approximately 103 centimeter to fit on a bag stand having industry standard dimensions. In this case, it is preferred that the lateral extent B of the bottom portion of the bag body fall within a range of approximately 73 to 90 centimeters. The lateral extent A of the upper portion of the bag body may preferably fall in a range of approximately 69 to 86 centimeters in this case. Under most preferred conditions, the lateral extent B of the bottom portion will be approximately 74.5 centimeters, with the lateral extent A of the upper portion being approximately 70 centimeters. These dimensions give a taper of 1 centimeter of narrowing for every 23 centimeter in height, which has been found to be a particularly useful taper to optimize application of force F while retaining adequate stability.

The length G of the tie members will preferably fall within a range of approximately 27 to 28 centimeters. The most preferred length for the tie members in this regard is approximately 27 centimeters. The width C of the tie members in the exemplary construction is approximately 2 centimeters at the first end portion whereas the width D is preferably approximately 7.5 centimeters at the second end portion. The break location (distance E) may be 20.5 centimeters from the second end portion in the exemplary construction.

It can thus be seen that the present invention provides a commercial laundry collection apparatus having a number of significant advantages when compared with the prior art. It will be understood that the present invention is not limited to the particularly described laundry bag and bag stand, but further includes others containing all or some of the mentioned components. It should also be understood that particular features of the invention can be interchanged in whole or in part. While the form of the invention shown and described herein constitutes a preferred embodiment of the invention, it is not intended to illustrate all possible forms of the invention. The words used are words of description rather than limitation. Various changes and variations may be made to the present invention without departing from the spirit and scope of the following claims.

What is claimed is:

1. A commercial laundry collection apparatus, said apparatus comprising:

an expandable bag stand including a support frame having an X-type configuration, said support frame comprising a pair of rectangular members pivotally joined at an intermediate location, said rectangular members defining a top bag supporting portion freely expandable to a predetermined maximum extent;

a removable laundry bag having a bag body constructed of a flexible sheet material and configured to retain soiled laundry, said bag body having a larger bottom portion, a smaller upper portion defining a bag mouth and lateral edges extending from said bottom portion to said upper portion, said lateral edges being tapered in a substantially constant manner such that the lateral extent of said bag body gradually decreases from said bottom portion to said upper portion;

said smaller upper portion of said bag body outwardly folded over said bag supporting portion of said bag stand such that said bag mouth is open for receipt of the soiled laundry therethrough; and said smaller upper portion of said bag body dimensioned such that said bag supporting portion of said bag stand will be unable to completely expand to the predetermined maximum extent, whereby said bag supporting portion of said bag stand imparts an outward force to said upper portion of said bag body tending to maintain said laundry bag on said bag stand.

2. A commercial laundry collection apparatus as in claim 1, wherein said laundry bag further includes a pair of longitudinal tie members attached to said smaller upper portion of said bag body at respective opposite locations across said bag mouth.

3. A commercial laundry collection system as in claim 2, wherein said tie members are respectively configured having a narrower width at a first end portion thereof and a wider width at a second end portion thereof, said first end portion attached to said smaller upper portion of said bag body.

4. A commercial laundry collection system as set forth in claim 3, wherein said tie members each have a length in a range of approximately 27 to 28 centimeters.

5. A commercial laundry collection system as set forth in claim 1, wherein said bag body has a height of approximately 103 centimeters and further wherein the width of said bottom portion of said bag body is in a range of approximately 73 to 90 centimeters and the width of said upper portion of said bag body is in a range of approximately 69 to 86 centimeters.

6. A commercial laundry collection system as set forth in claim 1, wherein the lateral extent of said bag body decreases approximately 1 centimeter for every 23 centimeter in height thereof.

7. A laundry bag suitable for use with a foldable bag stand, said laundry bag comprising:

a bag body constructed of flexible sheet material and having a front side and a back side, said front side and said back side conjoined along a bottom portion and further conjoined along first and second opposite edge portions, an upper portion of said bag body defining a bag mouth;

said bottom portion having a lateral extent greater than a lateral extent of said upper portion, said first and second opposite edge portions tapering from said bottom portion to said upper portion;

first and second tie members attached to said upper portion of said bag body at respective opposite locations across said bag mouth;

said first and second tie members each being planar and substantially flat and respectively extending from a first end portion attached to said upper portion of said bag body to a second end portion longitudinally distal from said first end, each of said tie members having a first side and a second side; and said tie members each having a first width at said first end portion and a second width at said second end portion, said second width being greater than said first width, said second width extending from said second end portion back towards said first end portion to a predetermined intermediate location, each of said tie members further tapering substantially uniformly at each of said sides from said intermediate location to said first end portion.

8. A laundry bag as set forth in claim 7, wherein said first width and said second width of said first and second tie members are approximately 7.5 centimeters and 2 centimeters, respectively.

9. A laundry bag as set forth in claim 8, wherein said first and second tie members each have a length of approximately 27 centimeters.

10. A laundry bag as set forth in claim 9, wherein the selected intermediate location is approximately 20.5 centimeters from said second end.

11. A laundry bag as set forth in claim 8, wherein the lateral extent of said bag body decreases approximately 1 centimeter for every 23 centimeter in height thereof.

12. A laundry bag as set forth in claim 7, wherein said bag body has a height of approximately 103 centimeter and further wherein the lateral extent of said bottom portion of said bag body is in a range of approximately 73 to 90 centimeters and the lateral extent of said upper portion of said bag body is in a range of approximately 69 to 86 centimeters.

13. A laundry bag as set forth in claim 12, wherein the lateral extent of said bottom portion of said bag body is approximately 74.5 centimeters and the lateral extent of said upper portion of said bag body is approximately 70 centimeters.

14. A laundry bag as set forth in claim 13, wherein said first and second tie members are attached to said upper portion of said bag body at locations adjacent respective of said first and second edge portions.

15. A laundry bag as set forth in claim 7, wherein said first and second tie members are respectively constructed of at least two plies of a polyester-cotton blend fabric material 16. A laundry bag as set forth in claim 15, wherein said front and back sides are constructed of a unitary piece of the flexible sheet material which is joined along the bottom portion and one of said first and second side portions to form a continuous seam.

17. A laundry bag as set forth in claim 7, wherein the lateral extent of said bag body decreases approximately 1 centimeter for every 23 centimeter in height thereof.

18. A commercial laundry collection apparatus, said apparatus comprising;

an expandable bag stand including a support frame, said support frame comprising a pair of overlapping frame members, said frame members being pivotally joined at an intermediate location, said frame members defining a top bag supporting portion freely expandable to a predetermined maximum extent;

a removable laundry bag having a bag body constructed of a flexible sheet material and configured to retain soiled laundry, said bag body having an upper portion defining a bag mouth;

said upper portion of said bag body outwardly folded over said bag supporting portion of said bag stand such that said bag mouth is open for receipt of the soiled laundry therethrough; and said laundry bag further including a pair of longitudinal tie members attached to said upper portion of said bag body at respective opposite locations across said bag mouth, said tie members being planar and substantially flat each having a length of between approximately 27 and 28 centimeters.

19. A commercial laundry collection apparatus as in claim 18, wherein said first and second tie members are respectively configured extending from said second end portion back to a selected intermediate location thereof at substantially said wider width and further uniformly taper from said selected intermediate location to said first end.

* * * * *